US010818413B2

(12) United States Patent
Lin

(10) Patent No.: US 10,818,413 B2
(45) Date of Patent: Oct. 27, 2020

(54) CABLE DEVICE

(71) Applicant: INTELLIGENCE TEXTILE TECHNOLOGY CO., LTD., Taipei (TW)

(72) Inventor: Chen-Hsiang Lin, Taipei (TW)

(73) Assignee: INTELLIGENCE TEXTILE TECHNOLOGY CO., LTD., Taipei (TW)

( * ) Notice: Subject to any disclaimer, the term of this patent is extended or adjusted under 35 U.S.C. 154(b) by 60 days.

(21) Appl. No.: 15/973,604

(22) Filed: May 8, 2018

(65) Prior Publication Data

US 2019/0244724 A1 Aug. 8, 2019

(30) Foreign Application Priority Data

Feb. 6, 2018 (TW) ..... 107104147 A

(51) Int. Cl.

| | |
|---|---|
| ***H01B 7/04*** | (2006.01) |
| ***H01B 7/00*** | (2006.01) |
| ***H01B 5/04*** | (2006.01) |
| ***H01B 5/14*** | (2006.01) |
| ***H01B 7/02*** | (2006.01) |
| ***H01B 11/12*** | (2006.01) |
| *H01B 7/06* | (2006.01) |

(52) U.S. Cl.

CPC ..... *H01B 7/04* (2013.01); *H01B 5/04* (2013.01); *H01B 5/14* (2013.01); *H01B 7/0018* (2013.01); *H01B 7/0216* (2013.01); *H01B 11/12* (2013.01); *H01B 7/06* (2013.01)

(58) Field of Classification Search

CPC ... H01B 5/04; H01B 5/14; H01B 7/04; H01B 7/0018; H01B 7/0216

USPC ..... 174/74 R, 78, 84 R, 88 C, 88 R, 110 R, 174/113 R, 120 R, 120 SR

See application file for complete search history.

(56) References Cited

U.S. PATENT DOCUMENTS 2,186,531 A * 1/1940 Kendrick ..... D02G 3/32 442/184
2,456,015 A * 12/1948 Orser ..... H01B 7/043 174/69
2,573,439 A * 10/1951 Henning ..... H01B 7/06 174/69
2,764,625 A * 9/1956 Ingmanson ..... H01B 7/06 174/69
3,334,177 A * 8/1967 Martin ..... H01B 11/1025 174/106 R (Continued)

*Primary Examiner* — William H. Mayo, III
(74) *Attorney, Agent, or Firm* — Schmeiser, Olsen & Watts, LLP

(57) ABSTRACT

A cable device has a first connector, a connecting cable and at least one electrical component. The connecting cable has at least one signaling yarn and a first textile. The at least one signaling yarn is arranged within the first textile and has a supporting material having a strength of 26S through 40S. One end of the at least one signaling yarn is electrically connected to the first connector, and one end of the first textile is connected to the first connector. The electric signals are propagated between the at least one electrical component and the first connector, and the at least one electrical component is electrically connected to the other end of the at least one signaling yarn and connected to the other end of the first textile.

15 Claims, 7 Drawing Sheets

(56) References Cited

U.S. PATENT DOCUMENTS

| | | | | | |
|---|---|---|---|---|---|
| 3,453,374 | A * | 7/1969 | Natwick | H01B 7/06 | 174/69 |
| 3,823,253 | A * | 7/1974 | Walters | H01B 7/06 | 174/69 |
| 4,683,349 | A * | 7/1987 | Takebe | H01B 7/06 | 174/113 C |
| 4,782,196 | A * | 11/1988 | Ukai | G02B 6/4415 | 156/50 |
| 8,286,563 | B2 * | 10/2012 | Low | B65D 19/0093 | 108/56.3 |
| 8,969,724 | B2 * | 3/2015 | Tatsumi | H01B 7/06 | 174/69 |
| 9,618,644 | B2 * | 4/2017 | Tong | G01L 5/101 | |
| 2001/0006173 | A1 * | 7/2001 | Rock | D04B 1/04 | 219/545 |
| 2002/0189839 | A1 * | 12/2002 | Wagner | H01B 3/00 | 174/68.1 |
| 2005/0282009 | A1 * | 12/2005 | Nusko | D02G 3/12 | 428/375 |
| 2010/0006320 | A1 * | 1/2010 | Tatsumi | H01B 7/06 | 174/113 R |
| 2013/0153264 | A1 * | 6/2013 | Huang | D02G 3/441 | 174/128.1 |
| 2016/0217885 | A1 * | 7/2016 | Kim | H01B 19/04 | |
| 2017/0107647 | A1 * | 4/2017 | Riethmuller | D02G 3/441 | |
| 2017/0311889 | A1 * | 11/2017 | Cobanoglu | A61B 5/11 | |
| 2017/0332442 | A1 * | 11/2017 | Strecker | A41D 13/0051 | |
| 2018/0195985 | A1 * | 7/2018 | Nebuya | G01N 27/02 | |
| 2019/0003083 | A1 * | 1/2019 | Carlsson | D02G 3/441 | |

* cited by examiner

CABLE DEVICE

CROSS-REFERENCE TO RELATED APPLICATION

This non-provisional application claims priority under 35 U.S.C. § 119(a) on Patent Application No(s). 107104147 filed in Taiwan, R.O.C. on Feb. 6, 2018, the entire contents of which are hereby incorporated by reference.

TECHNICAL FIELD

The present disclosure relates to cable devices, and more particularly, to a cable device having signaling yarns.

RELATED ART

In recent years, electronic products have been developed rapidly and commonly used in daily life. Each person uses more than one electronic product every day, and different electronic products are electrically connected via a plurality of cables to propagate electric signals or electrical energy. For example, a portable electronic device can be electrically connected to a power bank through a cable for charging. Alternatively, the portable electronic device can be electrically connected to a headphone device via the cable for propagating audio signals to headphone terminals.

Since the cable is often stretched or pulled accidentally or unexpectedly, the chance of damaging the cable is extremely high. The user needs to repair or replace the cable frequently, which obviously causes extra expenditure to the user and the usage inconvenience. Therefore, how to improve the strength resistance of cables is obviously one of the important topics in the field.

SUMMARY

In order to eliminate the above-mentioned disadvantages of the prior art, for example, a conventional cable is likely to be damaged when stretched under an external force, the present disclosure provides a cable device having better stretching ability and better strength resistance, and the cable device is able to improve the usage convenience.

The present disclosure provides an embodiment of a cable device, wherein the cable device has a first connector, a connecting cable and at least one electrical component. The connecting cable has at least one signaling yarn and a first textile, and the at least one signaling yarn is disposed within the first textile. The at least one signaling yarn further comprises a supporting material having a strength between 26S to 40S. One end of the at least one signaling yarn is electrically connected to one end of the first connector, and one end of the first textile is connected to the first connector. The at least one electrical component is electrically connected to the other end of the at least one signaling yarn and connected to the other end of the first textile.

In an embodiment of the present disclosure, the signaling yarn has a staple fiber, a sheet conductor and an insulating layer. The staple fiber is provided as the supporting material. The sheet conductor is enlacing a surrounding surface of the staple fiber in a spiral extending manner, wherein an aspect ratio of a cross section of the sheet conductor corresponding to the spiral extending manner is between about 10 and 30. The insulating layer surrounds the surrounding surface of the staple fiber to cover the sheet conductor and the staple fiber.

In order to further understand features and technical contents of the present disclosure, please refer to the following detailed descriptions of the present disclosure and the accompanying drawings, but these descriptions and drawings are only used to illustrate the present disclosure, but not impose any limitation on the scope of the present disclosure.

DETAILED DESCRIPTION OF THE PREFERRED EMBODIMENTS

To make it easier for the examiner to understand the objects, characteristics and effects of this present disclosure, embodiments together with the attached drawings for the detailed description of the present disclosure are provided.

Throughout the specification and claims the use of certain terms to refer to particular components. Throughout the specification and claims the use of certain terms to refer to particular components. As those skilled in the art will recognize, manufacturers can refer to components by different names. The specification does not distinguish between components with different names but the same functionality. In the following description and claims, the terms "including" and "comprising" are used in an open-ended fashion, and thus should not be interpreted as a closed-ended term such as "consisting of".

Figure 1A:
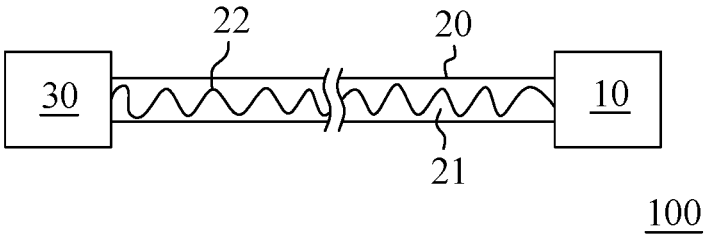
FIG. 1A is a schematic diagram of a first embodiment of a cable device according to the present disclosure.
Figure 1B:
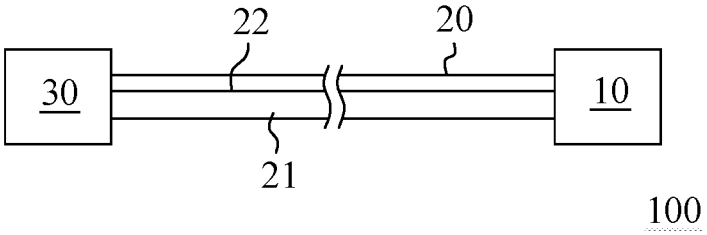
FIG. 1B is a schematic diagram of a second embodiment of the cable device according to the present disclosure.
Figure 1C:
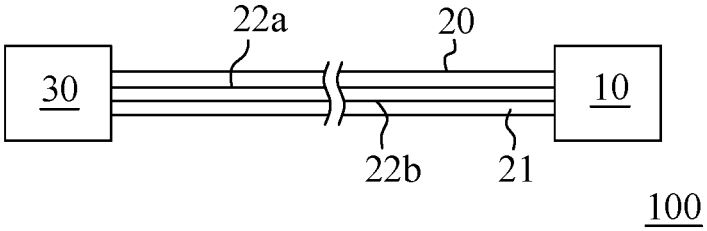
FIG. 1C is a schematic diagram of a third embodiment of the cable device according to the present disclosure.

Referring to FIG. 1A, FIG. 1B and FIG. 1C, wherein FIG. 1A is a schematic diagram of a cable device 100 according to a first embodiment of the present disclosure, FIG. 1B is a schematic diagram of the cable device 100 according to a second embodiment of the present disclosure, and FIG. 1C is a schematic diagram of the cable device 100 according to a third embodiment of the present disclosure.

The cable device 100 has a first connector 10, a connecting cable 20 and an electrical component 30, wherein the first connector 10 is electrically connected to one end of the connecting cable 20, the electrical component 30 is electrically connected to the other end of the connecting cable 20.

Electric signals or electrical energy is propagated between the electrical component 30 and the first connector 10 through the connecting cable 20.

In an embodiment of the present disclosure, the first connector 10 is a first connector plug for being electrically connected to the corresponding electronic device. The first connector 10 is selected from one of USB Type-A plug, USB Type-C plug, USB Micro-B plug, USB Mini-B plug, magnetic plug, Lightning plug or TRS connector, and the present disclosure is not limited thereto.

The electronic device can be implemented by portable electronic device, computer or power bank, and the present disclosure is not limited thereto.

The connecting cable 20 has a first textile 21 and a conductive wire element 22. The first textile 21 is selected from one of elastic textile or non-elastic textile. The first textile 21 is disposed between the first connector 10 and the electrical component 30 for connecting the first connector 10 to the electrical component 30, and the conductive wire element 22 is disposed within the first textile 21 to be electrically connected to the first connector 10 and the electrical component 30.

The conductive wire element 22 is disposed within the first textile 21 periodically. One end of the conductive wire element 22 is electrically connected to the first connector 10, and the other end of the conductive wire element 22 is electrically connected to electrical component 30. Therefore, the electric signals or electrical energy can be propagated between the first connector 10 and electrical component 30 through the conductive wire element 22.

In the embodiment of FIG. 1A, the first textile 21 is implemented by the elastic textile, and the conductive wire element 22 is periodically disposed within the first textile 21 in a wavy manner (for example, sine curve manner). In the embodiment, a stretching space is provided by the conductive wire element 22 disposed within the first textile 21 in the wavy manner. Thus, when the first textile 21 is stretched under an external force, the conductive wire element 22 can be stretched accompanying with the first textile 21 and will not be broken due to the external force.

In another embodiment of FIG. 1B, the first textile 21 is implemented by the non-elastic textile, and the conductive wire element 22 is periodically disposed within the first textile 21 in a straight-line manner.

In an embodiment of the present disclosure, the connecting cable 20 further has multiple conductive wire elements 22 according to different requirement. For example, in the embodiment of FIG. 1C, the connecting cable 20 has a conductive wire element 22*a* and a conductive wire element 22*b*. However, the present disclosure is not limited by the number of the conductive wire elements 22 of FIG. 1A, FIG. 1B or FIG. 1C.

In an embodiment of the present disclosure, the conductive wire element 22 is selected from one of the signaling yarn and enameled wire, and the present disclosure is not limited thereto. Moreover, different types of the conductive wire element 22 can be disposed within the same connecting cable 20 simultaneously. For example, in the embodiment of FIG. 1C, the conductive wire element 22*a* can be implemented by the signaling yarn and the conductive wire element 22*b* can be implemented by the enameled wire, and the present disclosure is not limited thereto.

In the embodiment, the enameled wire has an insulating paint, a material of the insulating paint is selected from one of polytetrafluoroethylene (PTFE, i.e. Teflon®), ethylene tetrafluoroethylene (ETFE), polyethylene terephthalate (PET), polyvinyl chloride (PVC), polyethylene (PE) or other polymer insulating materials, and the present disclosure is not limited thereto.

In an embodiment of the present disclosure, the first textile 21 is selected from one of polyester, polyamide, polyacrylonitrile, polyethylene, polypropylene, cellulose, protein, elastic fiber, poly perfluoroethylene, polyparaphenylene benzoxazole, polyether ketone, carbon and glass fiber, and the present disclosure is not limited thereto.

In an embodiment of the present disclosure, the electrical component 30 can be implemented by a speaker or audio signal receiving element. For example, the electrical component 30 can be the speaker of headphones or the audio signal receiving element of microphone.

In an embodiment of the present disclosure, the electrical component 30 can be a converter. For example, the electrical component 30 can be selected from one of card reader, RJ45 converter, 30 pin converter, TRS converter, HDMI converter, VGA converter and USB converter, and the present disclosure is not limited thereto.

In an embodiment of the present disclosure, the electrical component 30 can be a second connector plug. For example, the electrical component 30 can be selected from one of USB Type-A plug, USB Type-C plug, USB Micro-B plug, USB Mini-B plug, magnetic plug and Lightning plug, and the present disclosure is not limited thereto.

In an embodiment of the present disclosure, the electrical component 30 can be a battery device (for example, power bank) for providing electrical energy, and the present disclosure is not limited thereto.

Therefore, in the embodiments of the present disclosure, the electrical component 30 can be selected from one of different types to correspond to the first connector 10 according to different requirements. For example, when the first connector 10 is USB Type-C plug, the electrical component 30 can be selected from one of card reader, USB Type-A plug or USB converter accordingly, and the present disclosure is not limited thereto.

The conductive element 22 of the present disclosure will be further described below with the following drawings.

Figure 2:
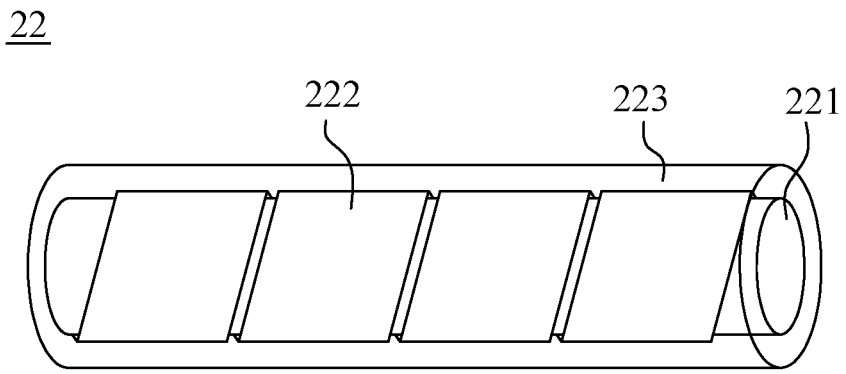
FIG. 2 is a three-dimensional schematic diagram of a conductive wire element according to an embodiment of the present disclosure.

Referring to FIG. 2, FIG. 2 is a three-dimensional schematic diagram of the conductive wire element 22 according to an embodiment of the present disclosure, wherein the conductive wire element 22 is implemented by the signaling yarn. In the embodiment, the conductive wire element 22 has a staple fiber 221, a sheet conductor 222 and an insulating layer 223. The staple fiber 221 is provided as a support material for supporting the sheet conductor 222 enlacing to the staple fiber 221. The sheet conductor 222 is enlacing a surrounding surface of the staple fiber 221 in a spiral extending manner to increase a strength resistance of the conductive wire element 22. The insulating layer 223 surrounds the surrounding surface of the staple fiber 221 to cover the sheet conductor 222 and the staple fiber 221.

Optionally, the strength resistance of the conductive wire element 22 can be increased by choosing the strength of the staple fiber 221 and/or an aspect ratio of a cross section of the sheet conductor 222 corresponding to the spiral extending manner. In the embodiment, the strength of the staple fiber 221 is 30S and the aspect ratio of the cross section of the sheet conductor 222 corresponding to the spiral extending manner is about 20, but the present disclosure is not limited thereto. For example, the strength of the staple fiber 221 is 26S, 28S or 40S, or the aspect ratio of the cross section of the sheet conductor 222 corresponding to the spiral extending manner is between 10 and 30.

In the embodiment, a material of the staple fiber 221 is selected from polyester, polyamide, polyacrylonitrile, polyethylene, polypropylene, cellulose, protein, elastic fiber, poly perfluoroethylene, polyparaphenylene benzoxazole, polyether ketone, carbon and glass fiber, and the present disclosure is not limited thereto. The material of the staple fiber 221 can be selected according to the requirements.

In the embodiment, a material of the sheet conductor 222 is alloy, such as copper-nickel alloy, copper-tin alloy, copper-nickel-silicon alloy, copper-nickel-zinc alloy, copper-nickel-tin alloy, copper-chromium alloy, copper-silver alloy, nickel-brass alloy, phosphor bronze alloy, beryllium copper alloy, nickel-chromium alloy, copper-tungsten alloy, stainless steel and other commercially conductive alloys, but the present disclosure is not limited thereto. In different applications, the material of the alloy can be different.

In the embodiment, a material of the insulating layer 223 is selected from polytetrafluoroethylene (PTFE, i.e. Teflon®), ethylene tetrafluoroethylene (ETFE), polyethylene terephthalate (PET), polyvinyl chloride (PVC), polyethylene (PE) and other polymer insulation materials, and the present disclosure is not limited thereto. The material of the sheet conductor 222 and the insulating layer 223 can be selected according to the actual demand.

Figure 3:
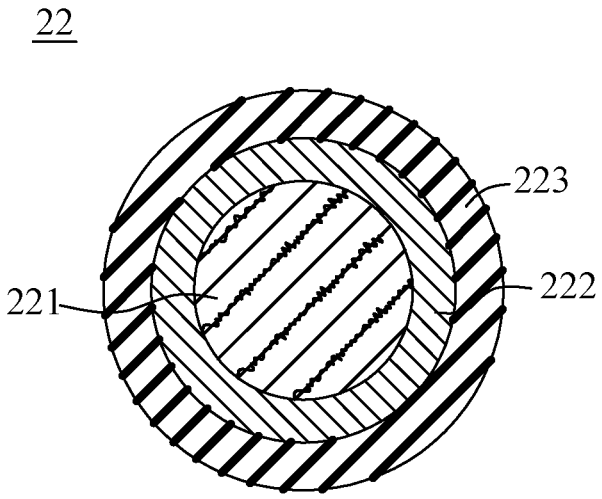
FIG. 3 is a sectional schematic diagram of the conductive wire element according to an embodiment of the present disclosure.

Please refer to FIG. 2 and FIG. 3, and FIG. 3 is a sectional schematic diagram of the conductive wire element 22 according to an embodiment of the present disclosure. In the section schematic diagram of the conductive wire element 22, as mentioned above, the staple fiber 221 is provided as a support material of a central layer of the conductive wire element 22, and the other two layers beside the staple fiber 221 are sequentially the sheet conductor 222 and the insulating layer 223. Though the conductive wire element 22 of the embodiment has only one sheet conductor 222 and one insulating layer 223, the present disclosure is not limited thereto. In other embodiments, there may be more layers of sheet conductors and insulating layers, for example, six layers or eight layers, and the number of layers may vary depending on the actual demands.

Figure 4:
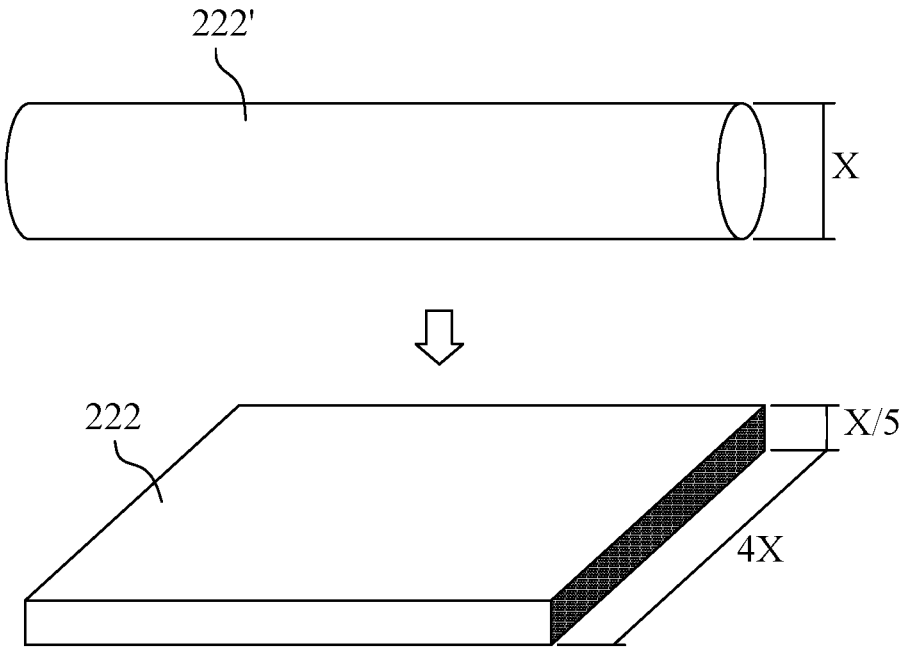
FIG. 4 is a schematic diagram of an implementation of a sheet conductor according to an embodiment of the present disclosure.

Please refer to FIG. 4, and FIG. 4 is a schematic diagram of an implementation of the sheet conductor 222 according to an embodiment of the present disclosure. In the embodiment, a length and a width of the cross section of the sheet conductor 222 are approximately 4X and X/5 respectively, wherein X is a diameter of the circular cross-section of a conductive wire 222'. The conductive wire 222' is rolled by a rolling mill to form the sheet conductor 222. However, the formation of the sheet conductor 222 is not intending to be a limitation of the present disclosure. In other words, there are different implementations of the sheet conductor 222 of the embodiment of the present disclosure.

Figure 5:
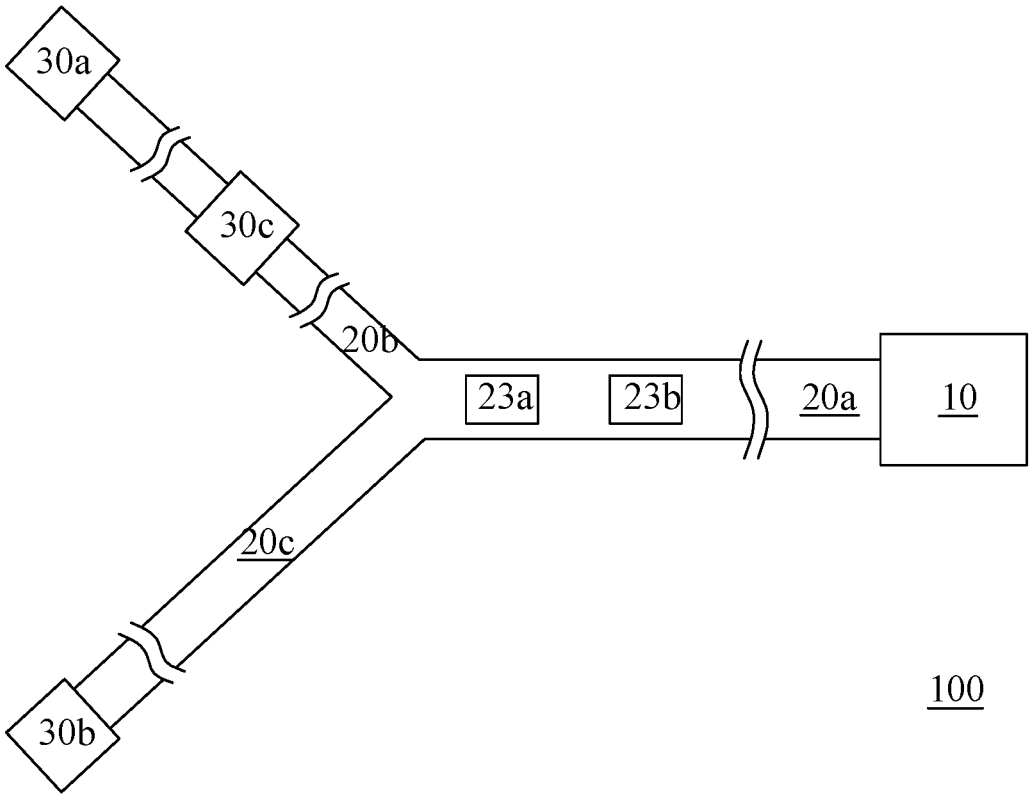
FIG. 5 is a schematic diagram of a fourth embodiment of the cable device according to the present disclosure.

Please refer to FIG. 5, and FIG. 5 is a schematic diagram of a cable device 100 according to a fourth embodiment of the present disclosure. In the embodiment, the connecting cable 20 further has a first sub connecting cable 20*a*, a second sub connecting cable 20*b* and a third sub connecting cable 20*c*. One end of the first sub connecting cable 20*a* is electrically connected to the first connector 10, and the other end of the first sub connecting cable 20*a* is electrically connected to one end of the second sub connecting cable 20*b* and one end the third sub connecting cable 20*c*. The first sub connecting cable 20*a* is further configured to have at least one control element 23. In the embodiment, the first sub connecting cable 20*a* is configured to have a control element 23*a* and 23*b*, and the present disclosure is not limited thereto. In the embodiment, the connecting cable 20 further has multiple electrical components 30. For example, the other end of the second sub connecting cable 20*b* is electrically connected to an electrical component 30*a* and an electrical component 30*c*, the other end of the third sub connecting cable 20*c* is electrically connected to an electrical component 30*b*, and the present disclosure is not limited thereto. In other words, the cable device 100 can have multiple connecting cables 20 and the control element 23 according to the requirements for increasing functional features of the cable device 100, and the present disclosure is not limited by the embodiment of FIG. 5.

In the embodiment of FIG. 5, the cable device 100 is illustrated as a headphone device. Therefore, the first connector 10 in the embodiment is used as TRS connector for being electrically connected to the electronic device. In the embodiment, the first sub connecting cable 20*a* is configured to have the control elements 23*a* and 23*b*, the control elements 23*a* and 23*b* are used to control the volume of the headphone device, such that the user can control the volume by the control elements 23*a* and 23*b*. In the embodiment, the electrical component 30*a* can be a left-channel headphone of the headphone device, the electrical component 30*b* can be a right-channel headphone of the headphone device, and the electrical component 30*c* is a microphone.

Figure 6:
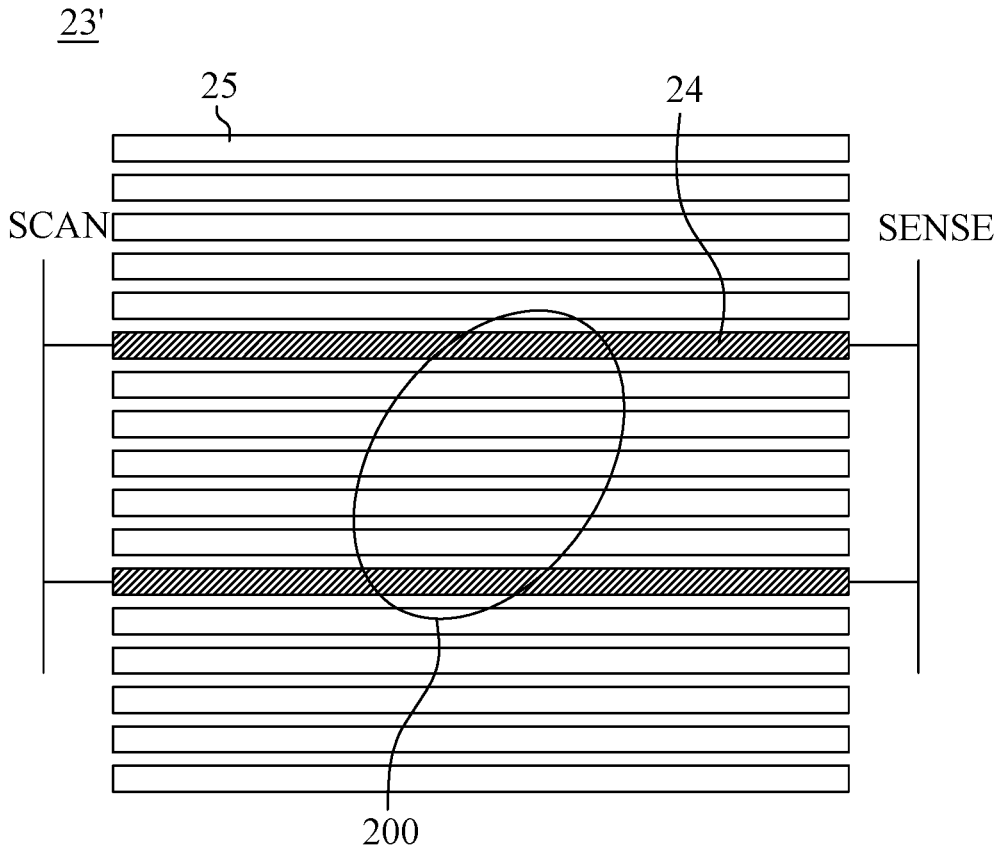
FIG. 6 is a schematic diagram of a control element of an embodiment of the present disclosure.

The control element 23 mentioned above can be implemented by touch textile, but such implementation is not intending to limit the present disclosure. Referring to FIG. 6, the control element 23' can be constructed by weaving signaling yarn 24 having no insulating layer and second textile 25. In the embodiment of the FIG. 5, the signaling yarn 24 of the control element 23*a* or 23*b* disposed within the first sub connecting cable 20*a* is electrically connected to the conductive wire element 22 of the first textile 21 for propagating the electric signals and electrical energy.

Referring to FIG. 6, one end of the signaling yarn 24 receives a scan signal SCAN transmitted from the electronic device (or electrical component 30*a*, 30*b*), and the electronic device (or electrical component 30*a*, 30*b*) receives a touch sensing signal SENSE transmitted from the other end of the second signaling yarn 24 for determining whether there is a touch object 200 (a finger or other touch object) that touches the control element 23.

In the embodiment, because the signaling yarn 24 has no insulating layer to cover thereto, the resistance generated by the touch object 200 touching the control element 23 will change the touch sensing signal SENSE. Therefore, the electronic device can determine whether there is a touch object 200 that touches the control element 23 according to the touch sensing signal SENSE (in other words, the control element 23 is provided as resistive touch sensing element in the embodiment).

Figure 7:
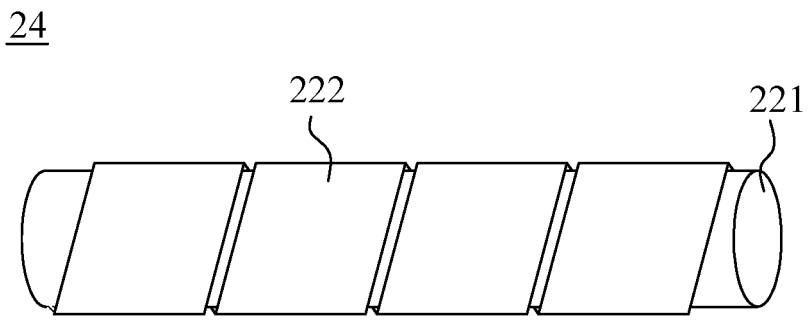
FIG. 7 is a three-dimensional schematic diagram of a signaling yarn of an embodiment of the present disclosure.
Figure 8:
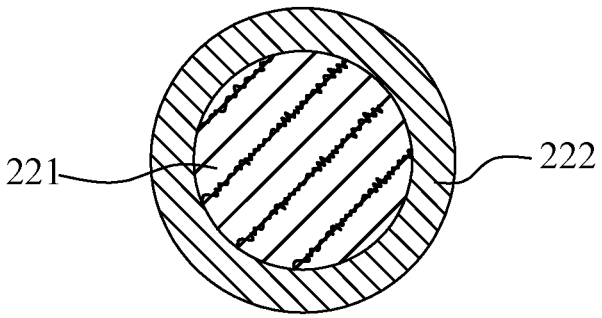
FIG. 8 is a sectional schematic diagram of the signaling yarn of an embodiment of the present disclosure.

An embodiment for implementing the signaling yarn 24 which has no insulating layer of the present disclosure will be further described below. Please referring to FIG. 7 and FIG. 8, FIG. 7 is a three-dimensional schematic diagram of the signaling yarn 24 according to an embodiment of the present disclosure, and FIG. 8 is a sectional schematic diagram of signaling yarn 24 according to an embodiment of the present disclosure. As shown in FIG. 7 and FIG. 8, the signaling yarn 24 has a staple fiber 221 and a sheet conductor 222. The staple fiber 221 is provided as a supporting material for supporting the sheet conductor 222 enlacing thereto. The sheet conductor 222 is enlacing the surround surface of the staple fiber 221 in a spiral extending manner to increase a strength resistance of the signaling yarn 24.

Figure 9:
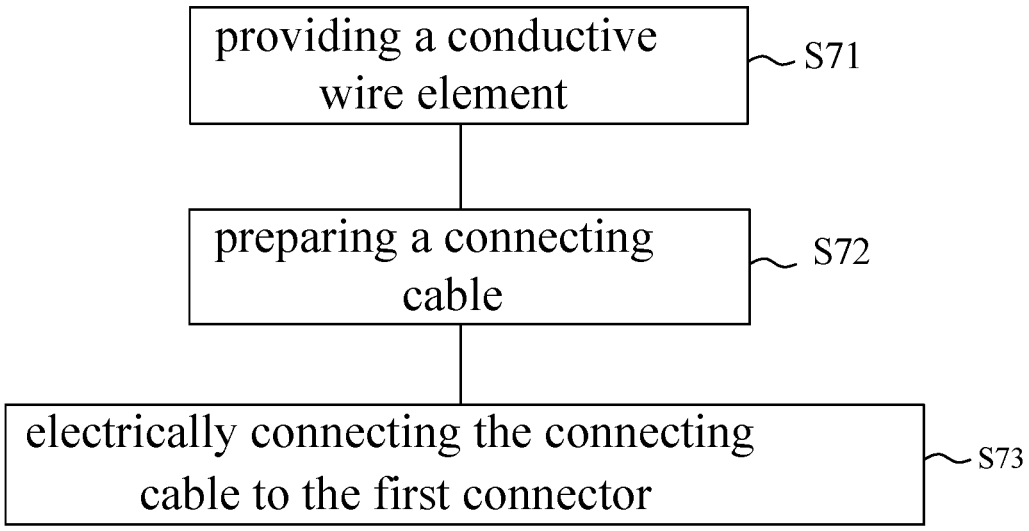
FIG. 9 is a flow chart of a manufacturing method of the cable device according to an embodiment of the present disclosure.

Please refer to FIG. 9, and FIG. 9 is a flow chart of a manufacturing method of the cable device 100 according to an embodiment of the present disclosure. First, in step S71, a conductive wire element 22 is provided. When the conductive wire element 22 is implemented by the signaling yarn, the conductive wire element 22 has a supporting material having strength between 26S and 40S. Second, in step S72, a connecting cable 20 is prepared, wherein the connecting cable 20 has a first textile 21 and at least one conductive wire element 22 disposed within the first textile 21. In an embodiment of the preset disclosure, in the step S72, at least one control element 23 is configured to have the connecting cable 20, and the at least one control element 23 is electrically connected to the at least one conductive wire element 22. In the final step S73, one end of the connecting cable 20 is electrically connected to first connector 10, and the other end of the connecting cable 20 is electrically connected to electrical component 30. More specifically, one end of the conductive wire element 22 is electrically connected to the first connector 10, the other end of the conductive wire element 22 is electrically connected to electrical component 30, one end of the first textile 21 is connected to the first connector 10, and the other end of the first textile 21 is connected to electrical component 30. Therefore, the cable device 100 according to the embodiment of the present disclosure is implemented according to the manufacturing method mentioned above.

As mentioned above, because the conductive wire element 22 of cable device 100 of the present disclosure is disposed with the first textile 21 in the wavy manner, the conductive wire element 22 can be stretched accompanying with first textile 21 and will not be broken due to the external force. In addition, in the embodiment that the signaling yarn is provided as the conductive wire element 22 of the present disclosure, the staple fiber 221 of the signaling yarn having strength between 26S and 40S is provided as the support material, and the sheet conductor 222 of the signaling yarn is enlacing the surrounding surface of the staple fiber 221 to increase the strength resistance of signaling yarn. The conductive wire element 22 of the present disclosure not only propagates the electric signals and electrical energy, but also has a better strength resistance. Therefore, the conductive wire element 22 will not easily be broken, and the life time and the strength resistance of the cable device 100 can be increased correspondingly.

While the present disclosure has been described by means of specific embodiments, numerous modifications and variations could be made thereto by those skilled in the art without departing from the scope and spirit of the present disclosure set forth in the claims.

What is claimed is:

1. A cable device, comprising:

a first plug electrically connected to an electronic device;

a connecting cable, comprising at least one signaling yarn and a first textile, wherein the at least one signaling yarn is disposed within the first textile, the at least one signaling yarn comprises a supporting material having a strength between 26S and 40S, one end of the at least one signaling yarn is electrically connected to one end of the first plug, and one end of the first textile is connected to the first plug;

at least one electrical component, electrically connected to the other end of the at least one signaling yarn and connected to the other end of the first textile; and a touch textile control element comprising weaving a plurality of uninsulated signaling yarns and a second textile; the touch textile control element electrically connected between the first plug and the at least one electrical component;

wherein a first end of the plurality of uninsulated signaling yarns receives a scan signal transmitted from the electronic device and the electronic device receives a touch sensing signal from a second end of the plurality of uninsulated signaling yarns for determining if an object touches the touch textile control element.

2. The cable device according to claim 1, wherein the at least one signaling yarn comprises:

a staple fiber, functioning as a supporting material;

a sheet conductor, enlacing a surrounding surface of the staple fiber in a spiral extending manner, wherein an aspect ratio of a cross section of the sheet conductor corresponding to the spiral extending manner is between about 10 and 30; and an insulating layer, surrounding the surrounding surface of the staple fiber to cover the sheet conductor and the staple fiber.

3. The cable device according to claim 2, wherein a material of the sheet conductor is selected from one of copper-nickel alloy, copper-tin alloy, copper-nickel-silicon alloy, copper-nickel-zinc alloy, copper-nickel-tin alloy, copper-chromium alloy, copper-silver alloy, nickel-brass alloy, phosphor bronze alloy, beryllium copper alloy, nickel-chromium alloy, copper-tungsten alloy and stainless steel.

4. The cable device according to claim 2, wherein a material of the insulating layer is selected from one of polytetrafluoroethylene (PTFE, i.e. Teflon®), ethylene tetrafluoroethylene (ETFE), polyethylene terephthalate (PET), polyvinyl chloride (PVC) and polyethylene (PE).

5. The cable device according to claim 2, wherein a material of the staple fiber is selected from one of polyester, polyamide, polyacrylonitrile, polyethylene, polypropylene, cellulose, protein, elastic fiber, poly perfluoroethylene, polyparaphenylene benzoxazole, polyether ketone, carbon and glass fiber.

6. The cable device according to claim 1, further comprising:

at least one control element, disposed within the first textile and electrically connected to the first plug and/or the electrical component.

7. The cable device according to claim 6, wherein the at least one control element comprises:

a staple fiber, provided as a supporting material; and a sheet conductor, enlacing a surrounding surface of the staple fiber in a spiral extending manner, wherein an aspect ratio of a cross section of the sheet conductor corresponding to the spiral extending manner is between about 10 and 30.

8. The cable device according to claim 7, wherein a material of the staple fiber is selected from one of polyester, polyamide, polyacrylonitrile, polyethylene, polypropylene, cellulose, protein, elastic fiber, poly perfluoroethylene, polyparaphenylene benzoxazole, polyether ketone, carbon and glass fiber.

9. The cable device according to claim 7, wherein a material of the sheet conductor is selected from one of copper-nickel alloy, copper-tin alloy, copper-nickel-silicon alloy, copper-nickel-zinc alloy, copper-nickel-tin alloy, copper-chromium alloy, copper-silver alloy, nickel-brass alloy, phosphor bronze alloy, beryllium copper alloy, nickel-chromium alloy, copper-tungsten alloy and stainless steel.

10. The cable device according to claim 1, wherein the first plug is selected from USB Type-A plug, USB Type-C plug, USB Micro-B plug, USB Mini-B plug, magnetic plug, Lightning plug or TRS connector.

11. The cable device according to claim 1, wherein the at least one electrical component is a speaker or an audio signal receiving element.

12. The cable device according to claim 1, wherein the at least one electrical component is selected from card reader, RJ45 converter, 30 pin converter, TRS converter, HDMI converter, VGA converter and USB converter.

13. The cable device according to claim 1, wherein the at least one electrical component is selected from USB Type-A plug, USB Type-C plug, USB Micro-B plug, USB Mini-B plug, magnetic plug and Lightning plug.

14. The cable device according to claim 1, wherein the connecting cable comprises at least one enameled wire disposed within the first textile, one end of the enameled wire is electrically connected to the first plug, the other end of the enameled wire is electrically connected to the electrical component.

15. The cable device according to claim 1, wherein the signaling yarn is periodically disposed within the first textile in a wavy manner.

* * * * *